United States Patent [19]

Kishimoto et al.

[11] Patent Number: 4,769,312

[45] Date of Patent: Sep. 6, 1988

[54] METHOD OF PROCESSING SILVER HALIDE COLOR PHOTOGRAPHIC MATERIAL INCLUDING THE USE OF A TWO BATH DESILVERING SYSTEM COMPRISING TWO BATHS

[75] Inventors: Shinzo Kishimoto; Akira Abe; Junya Nakajima, all of Minami-ashigara, Japan

[73] Assignee: Fuji Photo Film Co., Ltd., Kanagawa, Japan

[21] Appl. No.: 918,260

[22] Filed: Oct. 14, 1986

[30] Foreign Application Priority Data

Oct. 15, 1985 [JP] Japan ..... 60-227819
Oct. 18, 1985 [JP] Japan ..... 60-232472

[51] Int. Cl.[4] ..... G03C 5/44; G03C 7/32; G03C 7/34; G03C 7/42

[52] U.S. Cl. ..... 430/384; 430/385; 430/393; 430/421; 430/430; 430/460; 430/461; 430/462

[58] Field of Search ..... 430/430, 389, 393, 445, 430/460, 461, 462, 421, 385

[56] References Cited

U.S. PATENT DOCUMENTS

| | | | |
|---|---|---|---|
| 3,617,283 | 11/1971 | Ohi et al. | 430/393 |
| 3,809,563 | 5/1974 | Nimura et al. | 430/427 |
| 3,879,203 | 4/1975 | Schranz et al. | 430/393 |
| 3,893,858 | 7/1975 | Wabnitz, Jr. | 430/393 |
| 4,144,068 | 3/1979 | Ishibashi et al. | 430/393 |
| 4,304,846 | 12/1981 | Marthaler et al. | 430/393 |
| 4,500,635 | 2/1985 | Aoki et al. | 430/384 X |
| 4,563,405 | 1/1986 | Ishikawa et al. | 430/430 X |
| 4,621,047 | 11/1986 | Kishimoto et al. | 430/430 |

*Primary Examiner*—Mukund J. Shah
*Attorney, Agent, or Firm*—Burns, Doane, Swecker & Mathis

[57] ABSTRACT

A method of processing silver halide color photographic materials which comprises image-wise exposing said silver halide color photographic materials, color developing and then desilvering them in a bath having bleaching ability, characterized in that the bath having bleaching ability comprises two baths, the oxidation-reduction potential of the first bath being higher than that of the second bath, the oxidation-reduction potential of the second bath falling in the range of +60 mV to −60 mV, the first bath containing a water-soluble bromide in an amount of 0.5 to 1.3 mole/l, and the second bath containing a water-soluble bromide in an amount of 0 to 0.5 mole/l.

15 Claims, No Drawings

METHOD OF PROCESSING SILVER HALIDE COLOR PHOTOGRAPHIC MATERIAL INCLUDING THE USE OF A TWO BATH DESILVERING SYSTEM COMPRISING TWO BATHS

BACKGROUND OF THE INVENTION

1. Field of the Invention

The present invention relates to a method of processing silver halide color photographic materials, and particularly, to a processing method which is capable of carrying out desilvering sufficiently in a short period of time without any loss of photographic properties.

2. Description of the Prior Art

Generally, a basic process of processing color photographic materials consists of a color developing step and a desilvering step. In the color developing step, exposed silver halide is reduced by a color developing agent to yield silver ard, at the same time, the color developing agent reacts with a color forming agent (a coupler) to produce a dye image. In the subsequent desilvering step, the silver produced in the color developing step is oxidized by an oxidizing agent called a bleaching agent and, then, is dissolved by a complexing agent for silver ion called a fixing agent. By passing through the desilvering step, only the dye image is formed on the color photographic materials.

The above desilvering step is conducted by two baths, i.e., a bleaching bath containing a bleaching agent and a fixing bath containing a fixing agent, by a single bath of a bleach-fixing solution containing both a bleaching agent and a fixing agent, or by using a bleaching bath and a bleach-fixing bath.

Generally, ferricyanide, bichromate, ferric chloride, ferric aminopolycarboxylate complex and persulfate are known as a bleaching agent.

Ferric aminopolycarboxylate complex, particularly ferric ethylendiaminetetraacetate complex has only a little pollution problem unlike ferricyanide and bichromate and has no problem in storage unlike persulfate and, accordingly, is the most generally used bleaching agent. However, the bleaching ability of ferric aminopolycarboxylate complex is not always sufficient. It may attain the envisaged purpose when low speed silver halide photographic materials which mainly use a silver chlorobromide emulsion is subjected to a bleaching or bleach-fixing process. However, when high speed color photographic materials which mainly use a silver chlorobromoiodide or iodobromide emulsion and is color sensitized, particularly color reversal photographic materials used for photofinishing using an emulsion of a high silver content or color negative photographic materials used for photofinishing, are processed, disadvantages such as insufficient desilvering and long bleaching time arise.

On the other hand, West German Patent No. 866,605 specification discloses the use of a bleach-fixing solution containing ferric aminopolycarboxylate complex and thiosulfate as a method for accelerating the desilvering step. However, when the ferric aminopolycarboxylate complex having a weak oxidation ability (bleaching ability) is mixed with the thiosulfate having reduction ability, its bleaching ability is extremely decreased, and it is very difficult to sufficiently desilver high speed color light-sensitive materials for photofinishing of a high silver content and therefore this bleaching solution is impossible to be put into practical use.

Furthermore, a method has been proposed in which two or more bleach-fixing baths are used. For example, Japanese Patent Publication (unexamined) No. 11131/1974 (OLS-2217570) describes a method of processing in a continuous bleach-fixing bath comprising two or more baths to which a regenerated solution for bleach-fixing is supplied by a counter-current method. This method is capable of reducing the amount of waste solution generated from a bleach-fixing solution, but it has the problem that desilvering is not sufficiently carried out, particularly when color photographic materials containing a high content of iodine are processed, because the generated solution contains a high concentration of halogen ions eluted from the color photographic materials, as compared with that of a normal replenishing solution. Furthermore, Japanese Patent Publication (unexamined) No. 105148/1983 describes a method of improving the desilvering property in which at least two bleach-fixing baths are provided, and a fixing component is mainly supplied to the bleach-fixing bath which is near the color developing bath while a bleaching component is mainly supplied to the bleach-fixing bath which is near the water washing bath so as to effect the processing by a counter-current method. However, it is particularly difficult to sufficiently desilver the photographic materials for photofinishing by this method because the oxidation-reduction potential of the first bath is lower than that of the second bath.

Meanwhile, there have been proposed methods for increasing bleaching ability by incorporating various bleach accelerators into a bleaching bath, a bleach-fixing bath or a preceding bath thereof. Such bleach accelerators include mercapto compounds as described in U.S. Pat. No. 3,893,858, British Patent No. 1,138,841 and Japanese Patent Publication (unexamined) 141623/1978, compounds having a disulfide bond as described in Japanese Patent Publication (unexamined) No. 95630/1978, thiazolidine derivatives as described in Japanese Patent Publication No. 9854/1978, isothiourea derivatives as described in Japanese Patent Publication (unexamined) No. 94927/1978, thiourea derivatives as described in Japanese Patent Publications Nos. 8506/1970 and 26586/1974, thioamide compounds as described in Japanese Patent Publication (unexamined) No. 42349/1974, and dithiocarbamates as described in Japanese Patent Publication (unexamined) No. 26506/1980.

SUMMARY OF THE INVENTION

An object of the present invention is to provide a method of desilvering which is capable of achieving sufficient desilvering at a high speed. Another object of the present invention is to provide a method of desilvering which is capable of preventing the formation of leuco type of cyan dye.

The above-described objects of the present invention are achieved by a method of processing silver halide color photographic materials which comprises imagewise exposing the silver halide color photographic materials, color developing and desilvering them in a bath having bleaching ability, characterized in that the bath having bleaching ability comprises two baths, the oxidation-reduction potential of the first bath being higher than that of the second bath, the oxidation-reduction potential of the second bath falling in the range of +60 mV to −60 mV, the first bath containing a water-soluble bromide in an amount of 0.5 to 1.3 mole/l, and the second bath containing a water-soluble bromide in an amount of 0 to 0.5 mole/l.

In the present invention, the oxidation-reduction potential of the bath having the bleaching ability denotes the potential which is measured using a combination of a platinum electrode and silver chloride electrode at 25° C. and pH 6.0. A high oxidation-reduction potential means a strong bleaching power and a weak fixing power, while a low oxidation-reduction potential means a weak bleaching power and a strong fixing power. In the present invention, when the oxidation-reduction potential of the first bath is higher than that of the second bath, the oxidation-reduction potential of the latter falls in the range of +60 mV to −60 mV, the first bath contains a water-soluble bromide in an amount of 0.5 to 1.3 mole/l, and the second bath contains a water-soluble bromide in an amount of 0 to 0.5 mole/l, it is possible to achieve the expected results. However, it is preferred that the difference in the oxidation-reduction potential between the first and the second baths is 20 mV or higher, particularly 40 mV or higher. If the oxidation-reduction potential of the second bath is higher than +60 mV or lower than −60 mV, fixing or bleaching ability becomes insufficient respectively, which brings about inadequate desilvering.

A bleaching agent to be used in the bath having bleaching ability include compounds of polyvalent metals such as iron (III), cobalt (III), chromium (VI) and copper (II) such as ferricyanides, peroxides, quinones and nitroso compounds; bichromates; organic complex salts of iron (III) or cobalt (III) (e.g., complex salts of aminopolycarboxylic acid, such as ethylenediaminetetraacetic acid and diethylenetriaminepentaacetic acid, aminopolyphosphonic acid, phosphonocarboxylic acid and organic phosphonic acid), or organic acids such as citric acid, tartaric acid and malic acid; persulfates; hydrogen peroxide, and permanganates.

Among these, ferric ion organic complex salts and persulfates are particularly preferred from the viewpoint of facilitation of the process and environmental pollution.

In the present invention, the bath having bleaching ability contains a water-soluble bromide compound which dissolves in the bath having bleaching ability to release a bromide ion. Specific examples of such bromide compounds are an alkali metal bromide such as potassium bromide, sodium bromide and lithium bromide, ammonium bromide, hydrobromic acid, an alkaline earth metal bromide such as magnesium bromide, calcium bromide and strontium bromide. Among these, ammonium bromide is preferred.

These water-soluble bromide compounds are contained in the first bath having bleaching ability in an amount of 0.5 to 1.3 mole/l, particularly 0.7 to 1.3 mole/l. The second bath having bleaching ability also contains a water-soluble bromide in an amount of 0 to 0.5 mole/l, preferably 0.1 to 0.5 mole/l, particularly 0.2 to 0.5 mole/l. When more than 0.5 mole/l of the water-soluble bromide is contained in the second bath, fixing ability of the bath becomes lower.

Aminocarboxylic acids and aminopolyphosphonic acids and salts thereof useful for forming organic complex salts of ferric ion are named below:

ethylenediaminetetraacetic acid,
diethylenetriaminepentaacetic acid,
ethylenediamine-N-(β-oxyethyl)-N,N',N'-triacetic acid,
1,2-diaminopropanetetraacetic acid,
triethylenetetraminehexaacetic acid,
propylenediaminetetraacetic acid,
nitrilotriacetic acid,
nitrilotripropionic acid,
cyclohexanediaminetetraacetic acid,
1,3-diamino-2-propanoltetraacetic acid,
methyliminodiacetic acid,
iminodiacetic acid,
hydroxyliminodiacetic acid,
dihydroxyethylglycinethyletherdiaminetetraacetic acid,
glycoletherdiaminetetraacetic acid,
ethylenediaminetetrapropionic acid,
ethylenediaminedipropionic acid,
phenylenediaminetetraacetic acid,
2-phosphonobutane-1,2,4-triacetic acid,
1,3-diaminopropanol-N,N,N'-N'-tetramethylenephosphonic acid,
ethylenediamine-N,N,N',N'-tetramethylenephosphonic acid,
1,3-propylenediamine-N,N,N',N'-tetramethylenephosphonic acid,
1-hydroxyethylidene-1,1'-diphosphonic acid, and
sodium, potassium and ammonium salts thereof.

Among these, ferric ion complex salts of ethylenediaminetetraacetic acid, diethylenetriaminepentaacetic acid, cyclohexanediaminetetraacetic acid, 1,2-diaminopropanetetraacetic acid, methyliminodiacetic acid are preferred on account of their high bleaching power.

The ferric ion complex salt may be used in a form of one or more complex salt previously prepared or may be formed in a solution using a ferric salt, such as ferric sulfate, ferric chloride, ferric nitrate, ferric ammonium sulfate and ferric phosphate, and a chelating agent such as aminopolycarboxylic acid, aminopolyphosphonic acid and phosphonocarboxylic acid. When the complex salt is formed in a solution, one or more ferric salts may be used, and one or more chelating agents may also be used. In either case of the previously prepared complex salt or in the situ formed one, an excessive amount of the chelating agent to form the ferric ion salt may be used. Further, in the bleaching solution or the bleach-fixing solution containing the aforesaid ferric ion complex, complex salts of metal ions other than iron, such as cobalt and copper, or complex salts thereof or hydrogen peroxide may be contained.

The persulfates used in the present invention are, for instance, alkali metal persulfate such as potassium persulfate and sodium persulfate, and ammonium persulfate.

In the bleaching solution having bleaching ability, bromides such as potassium bromide, sodium bromide and ammonium bromide, chlorides such as potassium chloride, sodium chloride and ammonium chloride, or iodides such as ammonium iodide may be contained as a re-haloganating agent. As described earlier, water-soluble bromides are necessarily contained. If necessary, one or more inorganic or organic acids and alkali or ammonium salts thereof having a pH buffering ability, such as, boric acid, borax, sodium metaborate, acetic acid, sodium acetate, sodium carbonate, potassium carbonate, phosphorous acid, phosphoric acid, sodium phosphate, citric acid, sodium citrate and tartaric acid, anti-corrosives such as ammonium nitrate and guanidine may be added.

The amount of the bleaching agent is properly 0.1 to 2 moles per liter of a bleaching solution. The preferred pH range of the bleaching solution is 0.5 to 9.0 for ferric ion complex salts, particularly 4.0 to 8.5 for ferric ion complex salts of aminopolycarboxylic acid, aminopolyphosphonic acid, phosphonocarboxylic acid and organophosphonic acid. Persulfates are preferably used at a concentration of 0.1 to 2 moles/l and at a pH of 1 to 8.5.

In the bleaching solution used in the invention, a fixing agent may be contained. The fixing agent may be any conventional one, for instance, thiosulfates such as sodium thiosulfate and ammonium thiosulfate; thiocyanates such as sodium thiocyanate and ammonium thiocyanate; thioethers or thioureas such as ethylenebisthioglycolic acid, 3,6-dithia-1,8-octanediol, which are water soluble, silver halide-solubilizing agents. These agents may be used alone or in combination.

The concentration of the fixing agent is preferably 0.2 to 4 moles/l.

The bath having bleaching ability may further contain a preservative such as sulfite, for instance, sodium sulfite, potassium sulfite and ammonium sulfite, bisulfite, hydroxylamine, hydrazine, bisulfite addition product of aldehyde compounds, for instance, acetaldehyde sodium bisulfite, may be contained in addition to the aforesaid additives. Further, various fluorescent brighteners, defoaming agents, surfactants, polyvinylpyrrolidone or organic solvents such as methanol may also be contained.

In the bleaching bath, and preceding bath thereof, a bleaching accelerator may be used if necessary. Typical examples of useful bleaching accelerators are illustrated below.

Namely, in the present invention, the bleach accelerators optionally contianed in the bath having the bleaching ability are selected from compounds having mercapto groups or disulfide bonds, thiazolidine derivatives, thiourea derivatives, and isothiourea derivatives, and having a bleach accelerating effect, preferably ones shown by the following general formulae (I) to (IX):

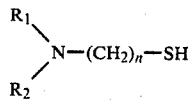

Formula (I)

wherein $R_1$ and $R_2$ may be the same or different, and denote a hydrogen atom, a substituted or non-substituted lower alkyl group (preferably having 1 to 5 carbon atoms, and particularly methyl group, ethyl group, or propyl group), or an acyl group (preferably having 1 to 3 carbon atoms, for example, acetyl group or propionyl group), and n denotes an integer of 1 to 3, or $R_1$ and $R_2$ may be bonded to each other to form a ring.

In particular, $R_1$ and $R_2$ are preferably a substituted or non-substituted lower alkyl group, with substituents possessed by $R_1$ and $R_2$ including a hydroxyl group, a carboxyl group, a sulfo group, and an amino group.

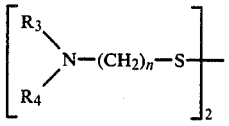

Formula (II)

wherein $R_3$ and $R_4$ are the same as $R_1$ and $R_2$ of the formula (I) and n denotes an integer of 1 to 3; and $R_3$ and $R_4$ may be bonded to each other to form a ring.

In particular, $R_3$ and $R_4$ are preferably substituted or non-substituted lower alkyl groups, with the substituents possessed by $R_3$ and $R_4$ including a hydroxyl group, a carboxyl group, a sulfo group, and an amino group.

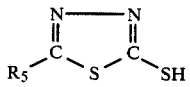

Formula (III)

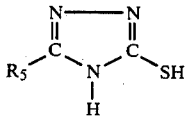

Formula (IV)

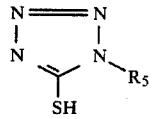

Formula (V)

wherein $R_5$ denotes a hydrogen atom, a halogen atom (for example, chlorine or bromine atom), an amino group, a substituted or non-substituted alkyl group (preferably having 1 to 5 carbon atoms, and particularly, a methyl group, an ethyl group, a propyl group), or an amino group having alkyl groups (a methyl amino, an ethyl amino, a dimethyl amino, or a diethyl amino group, and wherein the substituents possessed by $R_5$ include a hydroxyl group, a carboxyl group, a sulfo group, and an amino group.

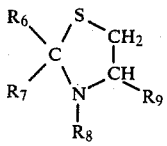

Formula (VI)

wherein $R_6$ and $R_7$ may be the same or different and denote a hydrogen atom, an alkyl group optionally having a substituent (preferably, a lower alkyl group such as methyl group, ethyl group, and propyl group), a phenyl group optionally having a substituent, and a heterocyclic group having a substituent (particularly, a heterocyclic group having at least one nitrogen atom, oxygen atom, or sulfur atom, such as pyridine ring, thiophene ring, thiazolidine ring, benzoxazole ring, benzotriazole ring, thiazole ring, and imidazole rings), and $R_8$ denotes the same as $R_6$;

$R_6$ denotes a hydrogen atom or a lower alkyl group optionally having a substituent (for example, a methyl or ethyl group, and preferably having 1 to 3 carbon atoms);

The substituents possessed by $R_6$ and $R_8$ include a hydroxyl group, a carboxyl group, a sulfo group, an amino group, and a lower alkyl group; and $R_9$ denotes a hydrogen atom or a carboxyl group.

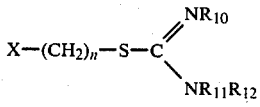

Formula (VII)

wherein $R_{10}$, $R_{11}$ and $R_{12}$ may be the same or different, and denote a hydrogen atom, a lower alkyl group (for example, methyl group or ethyl group, and preferably an alkyl group having 1 to 3 carbon atoms);

$R_{10}$ may be bonded to $R_{11}$ or $R_{12}$ to form a ring; and

X denotes an amino group, a sulfonic acid, group, or a carboxyl group optionally having a substituent (for example, a lower alkyl group such as methyl group or an alkoxyalkyl group such as acetoxymethyl group).

In particular, $R_{10}$ to $R_{12}$ are preferably a hydrogen atom, a methyl group, or an ethyl group, and X is preferably an amino group or a dialkylamino group.

Formula (VIII)

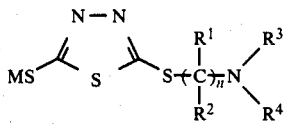

wherein $R^1$ and $R^2$ denote a hydrogen atom, a hydroxyl group, a substituted or non-substituted amino group, a carboxyl group, a sulfo group, or a substituted or non-substituted alkyl group;

$R^3$ and $R^4$ denote a hydrogen atom, a substituted or non-substituted alkyl group, or a substituted or non-substituted acyl group, and they may be bonded to each other to form a ring;

M denotes a hydrogen atom, an alkali metal atom, or an ammonium group; and n denotes an integer of 2 to 5.

Formula (IX)

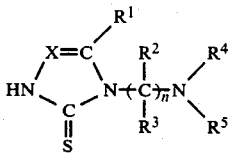

wherein X denotes N or C-R;

R, $R^1$, $R^2$, and $R^3$ denote a hydrogen atom, a halogen atom, an amino group, a hydroxyl group, a carboxyl group, a sulfo group, or a substituted or non-substituted alkyl group;

$R^4$ and $R^5$ denote a hydrogen atom, a substituted or non-substituted alkyl group, or an acyl group, and may be bonded to each other to form a ring, provided that both $R^4$ and $R^5$ are a hydrogen atom at the same time; and n denotes an integer of 0 to 5.

Preferable examples are listed hereinafter.

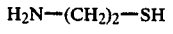

(I)-(1)

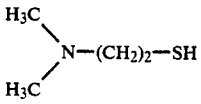

(I)-(2)

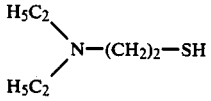

(I)-(3)

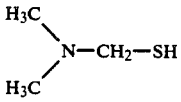

(I)-(4)

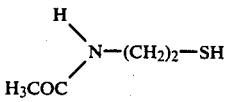

(I)-(5)

-continued

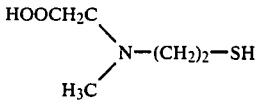

(I)-(6)

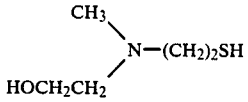

(I)-(7)

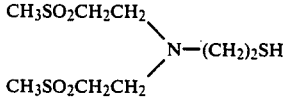

(I)-(8)

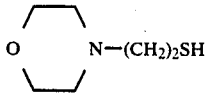

(I)-(9)

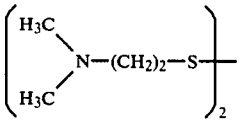

(II)-(1)

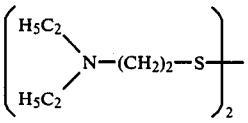

(II)-(2)

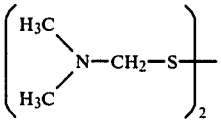

(II)-(3)

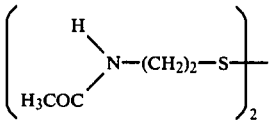

(II)-(4)

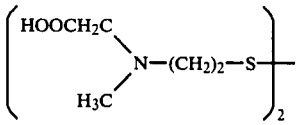

(II)-(5)

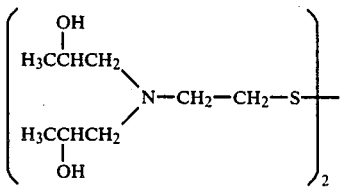

(II)-(6)

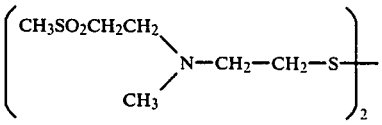

(II)-(7)

-continued
(II)-(8)
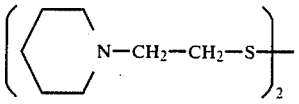
(II)-(9)
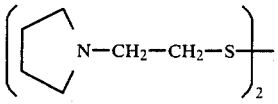
(II)-(10)
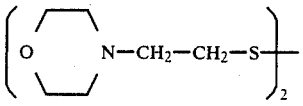
(III)-(1)
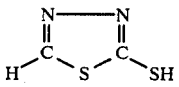
(III)-(2)
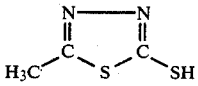
(III)-(3)
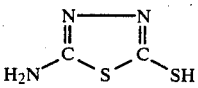
(III)-(4)
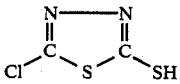
(IV)-(1)
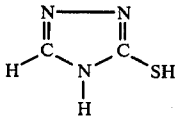
(IV)-(2)
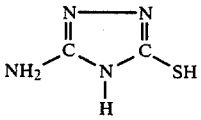
(IV)-(3)
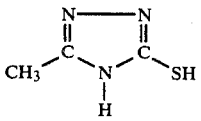
(V)-(1)
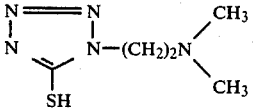
(V)-(2)
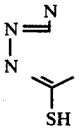
(VI)-(1)
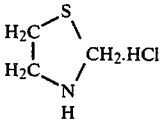
-continued
(VI)-(2)
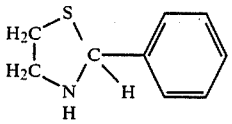
(VI)-(3)
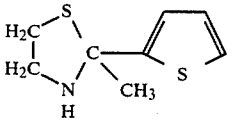
(VI)-(4)
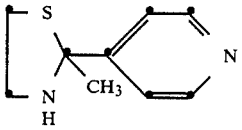
(VI)-(5)
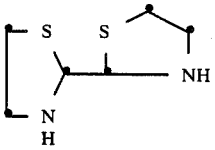
(VI)-(6)
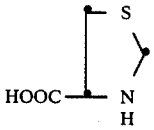
(VII)-(1)
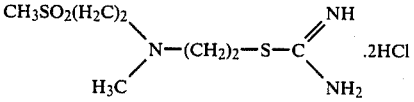
(VII)-(2)
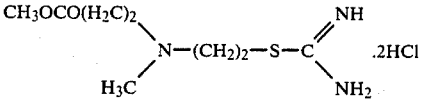
(VII)-(3)
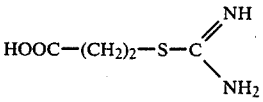
(VII)-(4)
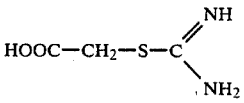
(VII)-(5)
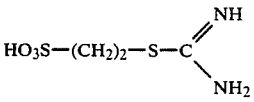
(VII)-(6)
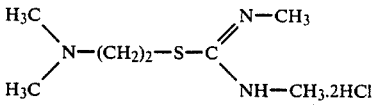
(VII)-(7)
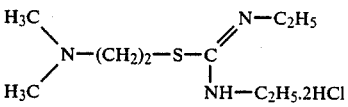
(VII)-(8)
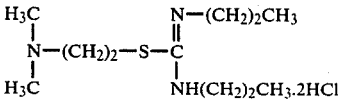

-continued

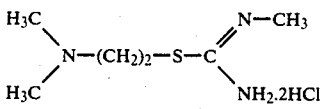
(VII)-(9)

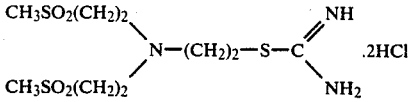
(VII)-(10)

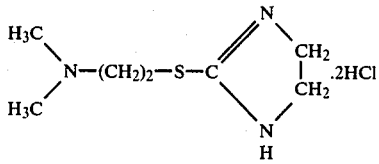
(VII)-(11)

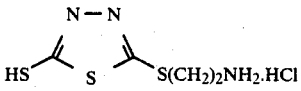
(VIII)-(1)

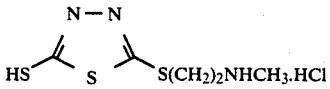
(VIII)-(2)

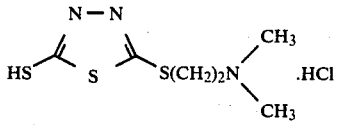
(VIII)-(3)

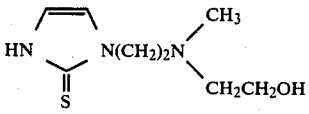
(IX)-(1)

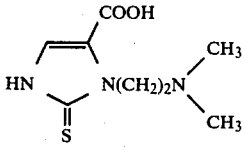
(IX)-(2)

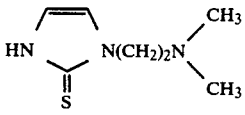
(IX)-(3)

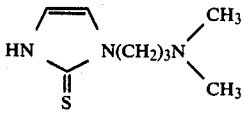
(IX)-(4)

Any one of the above-described compounds can be synthesized by known methods, and particularly, the compounds shown by the formula (I) can be easily synthesized by the alkylation of 2,5-dimercapto-1,3,4-thiadiazole (refer to U.S. Pat. No. 4,285,984, G. Schwarzenbach et al., Helv. Chim. Acta., 38, 1147 (1955), R. O. Clinton et al., J. Am. Chem. Soc., 70, 950 1948)). The compounds shown by the formula (II) can be easily synthesized by alkylation of the same compound (refer to Japanese Patent Publication No. (unexamined) 95630/1978. The compounds shown by the formulae (III) and (IV) can similarly be synthesized by the method disclosed in Japanese Patent Publication No. (unexamined) 52534/1979; the compounds shown by the formula (V) by the method disclosed in Japanese Patent Publications Nos. (unexamined) 68568/1976, 70763/1976, and 50169/1978, the compounds shown by the formula (VI) by the method of Japanese Patent Publication No. 9854/1978 and Japanese Patent Publication No. (unexamined) 88938/1983, the compounds shown by the formula (VII) by the method of Japanese Patent Publication No. (unexamined ) 94927/1978, and the compounds shown by the formula (VIII) by the method disclosed in Advanced Heterocyclic Chemistry, 9, 165–209 (1968). The compounds shown by the formula (IX) can be synthesized in accordance with the methods described in A. Wohl, W. Marckwald, Ber., 22, 568 (1889), M. Freund, Ber., 29, 2483 (1896), A. P. T. Easson et al., J. Chem. Soc., 1932, 1806, and R. G. Jones et al., J. Am. Chem. Soc., 71, 400 (1949).

The amount of the compounds having mercapto groups or disulfide bonds in the above-described molecules, the thiazolidine derivatives, or the isothiourea derivatives for addition to the solution having bleaching ability depends upon the kinds of photographic materials to be processed, the processing temperature and the time required for the intended processing, but it may suitably be $1\times10^{-5}$ to $10^{-1}$ mole per liter, preferably $1\times10^{-4}$ to $5\times10^{-2}$ mole per liter.

In order to add these compounds to the treatment solution, they are generally dissolved in a solvent such as water or an organic solvent of an alkali organic acid before the addition. However, powder of the compounds may be directly added to the bath having bleaching ability, without producing any influence on its bleaching acceleration effect.

The pH of the bath having the bleaching ability and used in the present invention is 0.5 to 9, preferably 5 to 8.5.

In the present invention, the processing time in the first bath is suitably 20 seconds to 4 minutes, preferably 20 seconds to 2 minutes, when the bleach accelerators shown by the formulae (I) to (IX) are used, and preferably 1 to 4 minutes, when such accelerators are not used.

The processing time in the second bath is suitably 1 to 6 minutes, preferably 1.5 to 4.5 minutes.

Any silver halide out of silver bromide, silver iodobromide, silver iodochlorobromide, silver chlorobromide, silver iodochloride and silver chloride may be used in photographic emulsion layers in the photographic light-sensitive materials used in the present invention. Preferred silver halide is silver iodobromide or iodochlorobromide containing not higher than 30 mol % silver iodie. Silver iodobromide containing 2 to 25 mol % silver iodide is particularly preferred.

The silver halide grains in the photographic emulsions may be so-called regular grains having a regular crystal form such as cubic, octahedron or fourteenhedron. Alternatively, the grains may be of an irregular crystal structure such as spherical, or ones having crystal defects such as a twinning plane, or composite form thereof.

Regarding the grain size of silver halide, the grains may be fine grains having a size of 0.1μ or less, or may be large size grains having a diameter of the projected area of up to 10μ. They may be monodispersed grains having a narrow distribution or polydispersed grains having a broad distribution.

Photographic emulsions to be used in the present invention may be prepared according to, for instance, the methods described in P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964. That is, any of an acid method, neutral method and ammoniacal method may be used. Further, a single-jet, simultaneous jet method or a combination thereof may be used for reacting a soluble silver salt with a soluble halogen salt. A method of forming grains in silver ion-excessive condition, i.e., so-called reverse jet method, may be used. As one of the simultaneous jet method, a method where pAg is maintained constant in a liquid phase in which silver halide forms, i.e., controlled double jet method, may also be used. This method yields silver halide emulsion in which a crystal form is regular and a grain size is uniform.

It is also possible to mix more than two silver halides which have separately formed.

The aforesaid silver halide emulsion having regular grains is obtained by controlling pAg and pH during the formation of grains. Details are disclosed in, for instance, Photographic Science and Engineering, vol. 6, pp 159 to 165 (162), Journal of Photographic Science, vol. 12, pp 242 to 251 (1964), U.S. Pat. No. 3,655,394 and U.K. Patent No. 1,413,748.

Monodisperse emulsions are described in Japanese Patent Publications Nos. (unexamined) 8600/1972, 39027/1976, 83097/1976, 137133/1978, 48521/1979, 99419/1979, 37635/1983, and 49938/1983, Japanese Patent Publication No. 11386/1971, U.S. Pat. No. 3,655,394, and U.K. Patent No. 1,413,748.

Furthermore, flat grains having an aspect ratio of 5 or more may be used in the present invention. Such flat grains can be easily prepared by the methods described in Cleve, "Photography Theory and Practice" (1930), pp 131, Gutoff, "Photographic Science and Engineering", vol. 14, pp 248 to 257 (1970), (U.S. Pat. Nos. 4,434,266, 4,414,310, and 4,433,048, and U.K. Patent No. 2,112,157. The use of flat grains has the advantage of providing an improvement in covering power and in the color sensitizing efficiency by sensitizing dye, this being described in detail in the above-cited U.S. Pat. No. 4,434,226.

Grains may be homogeneous crystal structure or may have different silver halide compositions in the inner part and the outer part or may have layered structure. Such emulsion grains are disclosed in U.K. Patent No. 1,027,146, U.S. Pat. Nos. 3,505,608 and 4,444,877, and Japanese Patent Publication No. (unexamined) 143331/1985. More than 2 types of silver halides which have different compositions may be connected by epitaxial connection. Alternatively, silver halide may be connected with compounds other than silver halide, such as rhodan silver and lead oxide. Such emulsion grains are disclosed in U.S. Pat. Nos. 4,094,684; 4,142,900; 4,459,353; 4,349,622; 4,395,478; 4,433,501; 4,463,087; 3,656,962; and 3,852,067; U.K. Patent No. 2,038,792; and Japanese Patent Publication No. (unexamined) 162540/1984.

It is also possible to use a mixture of various crystal types of grain.

Various color couplers may be used in the color photographic materials employed in the present invention, typical examples being the cyan-, magenta-, and yellow-forming couplers described in the patents cited in Research Disclosure, 17643 (December, 1978) VII-D; and 18717 (November, 1979). These couplers are preferably made non-diffusible by having ballast groups or being polymerized to dimers or higher polymers, and they may be 4 equivalent of 2 equivalent. Couplers which improve graininess by the diffusion of formed dyes and DIR couplers which release upon a coupling reaction a development restrainer to bring about edge effect or multilayer effect may be used.

The yellow couplers used in the present invention are preferably α-pivaloyl or α-benzoyl acetanilide type couplers which are either of the oxygen atom splitting-off type or the nitrogen atom splitting-off type. Preferable examples of the 2-equivalent couplers include the yellow couplers of the oxygen atom splitting-off type described in U.S. Pat. Nos. 3,408,194, 3,447,928, 3,933,501, and 4,022,620, or those of the nitrogen atom splitting-off type described in U.S. Pat. Nos. 3,973,968 and 4,314,023, Japanese Patent Publication No. 10739/1983, Japanese Patent Publication No. (unexamined) 132926/1975, and DEOS,s Nos. 2,219,917; 2,261,361; 2,329,587; and 2,433,812.

In the present invention, a usual magenta coupler of a low molecular weight may be used together with a 2-equivalent magenta polymer coupler. For example, it is possible to use 5-pyrazolone type couplers, the pyrazolo, 5, 1-c. ,1,2,4. triazoles described in U.S. Pat. No. 3,725,067, or the pyrazolo, 1, 5-b. ,1,2,4. triazoles described in European Patent No. 119,860. It is preferable to use magenta couplers which are dimerized at coupling active positions through nitrogen or sulfur atom of splitting-off the groups.

As cyan couplers, those having resistance to heat and humidity are preferably used, and typical examples include the phenol type couplers described in U.S. Pat. No 3,772,002, the 2,5-diacylaminophenol type couplers described in Japanese Patent Publications Nos. (unexamined) 31953/1984, 166956/1983, and 24547/1985, phenol type couplers having phenylureido groups at their 2-positions and acylamin groups at their 5-positions, and the naphthol type couplers described in Japanese Patent Publication No. (unexamined) 137448/1985.

According to the process of the present invention, color photographic materials in which cyan couplers of the following formula (X) or (XI) are incorporated give good cyan color reproduction without softening of gradation of a cyan image.

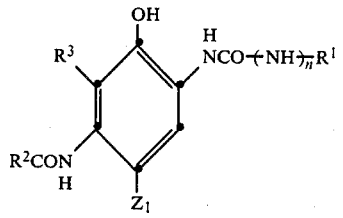

Formula (X)

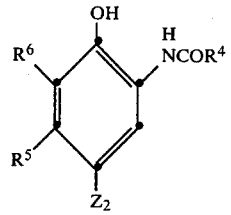

Formula (XI)

wherein $R^1$, $R^2$ and $R^4$ represent a substituted or non-substituted aliphatic hydrocarbyl, aryl or heterocyclic group, $R^3$ and $R^6$ represent hydrogen atom, halogen atom, a substituted or non-substituted aliphatic, aryl or acylamino group, or $R^3$ represents a non-metallic atom group necessary for forming a 5-or 6-membered nitrogen-containing ring together with $R^2$. $R^5$ represents an alkyl group which may be substituted. $Z_1$ and $Z_2$ represent hydrogen atom or a group which splits off upon coupling reaction. Examples of the cyan couplers of the formula (X) or (XI) are illustrated below:

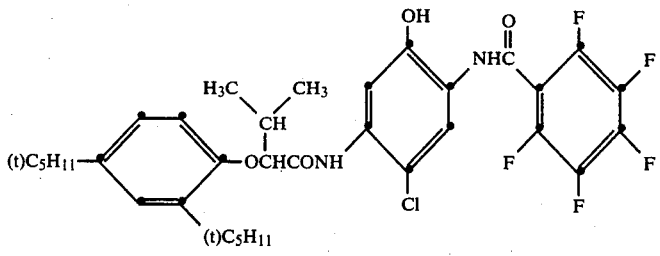

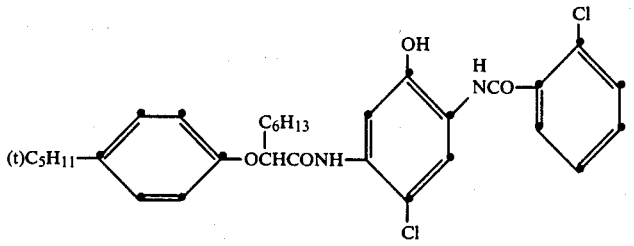

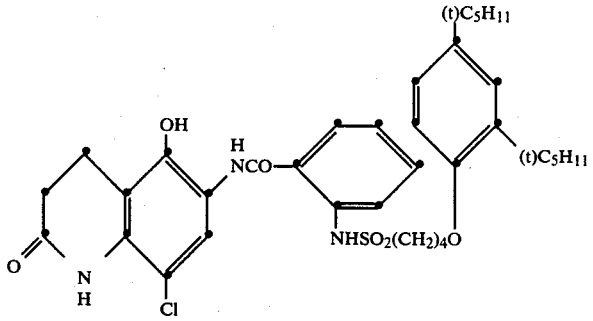

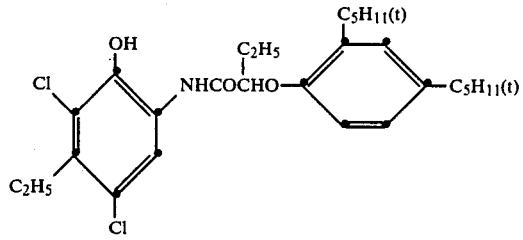

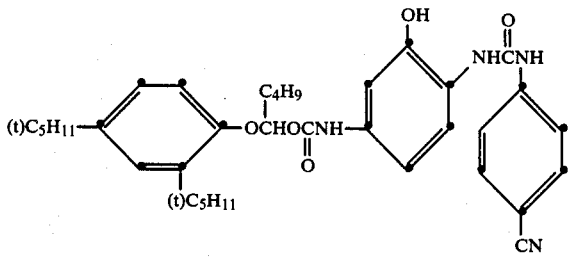

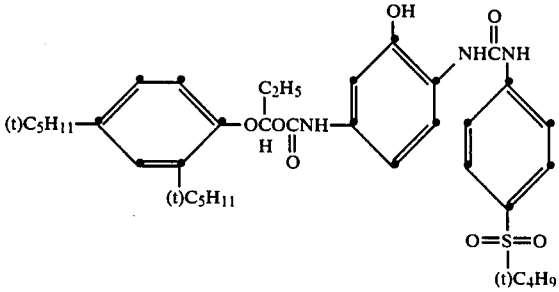

-continued

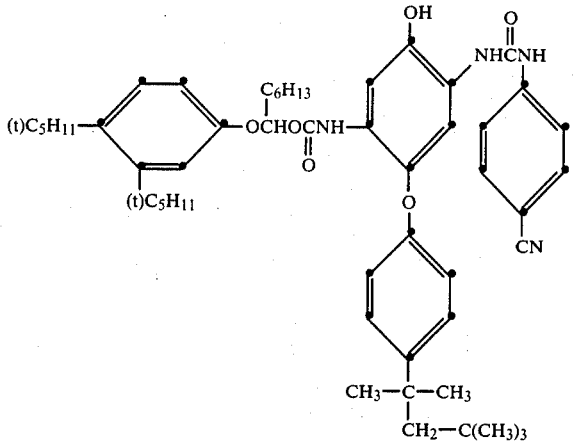

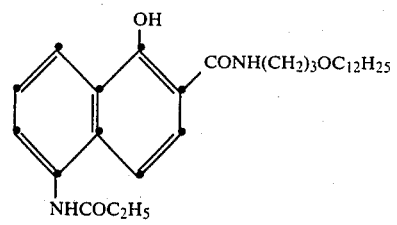

In order to compensate for any unwanted minor absorption in the short-wave region of the main absorption of the formed dye, it is preferable to use yellow and magenta color couplers together. These couplers are dissolved in a high-boiling point organic solvent such as phthalic ester or phosphoric ester which generally have 16 to 32 carbon atoms using, if necessary, an organic solvent such as ethyl acetate, and are then subjected to emulsion dispersion in an aqueous medium and used. The standard amount of the color couplers to be used is preferably 0.01 to 0.5 mole for yellow couplers, 0.003 to 0.3 mole for magenta couplers and 0.002 to 0.3 mole for cyan couplers, permole of light-sensitive silver halide.

The silver halide photographic emulsion which can be used in the present invention is produced by a known method, for example, by one of the methods described in Research Disclosure (RD) No. 17643 (December, 1978), pp 22 to 23, "I, Emulsion Preparation and Types" and Research Disclosure No. 18716 (November, 1976), pp 648. The flat grains described in U.S. Pat. Nos. 4,434,226 and 4,439,520, and Research Disclosure, No. 22534 (January, 1983) may be used in the present invention.

Various photographic additives which can be used in the present invention are described in, for example, the above-mentioned Research Disclosure No. 17643, pp 23 to 28 and No. 18716, pp 648 to 651. The Types of these additives and pages on which they are described in detail are given in the following table:

| Additive | RD17643 | RD18716 |
|---|---|---|
| 1. Chemical sensitizing agent | page 23 | page 648, right column |
| 2. Sensitivity enhancing agent | | page 648, right column |
| 3. Spectral sensitizing agent, Supersensitizing agent | pages 23 and 24 | page 648, right column to page 649, right column |
| 4. Antifoggant, Fogging stabilizing agent | pages 24 and 25 | page 649, right column |
| 5. Light absorbing agent, Filter dye, UV absorbing agent | pages 25 and 26 | page 649, right column to page 650, left column |
| 6. Antistain agent | page 25, right column | page 650, left to right column |
| 7. Hardening agent | page 26 | page 651, left column |
| 8. Binder | page 26 | page 651, left column |
| 9. Plasticizer, Lubricant | page 27 | page 650, right column |
| 10. Coating aid, Surface activator | pages 26 and 27 | page 650, right column |
| 11. Antistatic | page 27 | page 650, right column |

In the present invention, a water-washing step may be provided between the first and second baths having the bleaching ability. If the water-washing step consists of a washing bath which uses a small amount of water so that the amount of water supplied is greatly reduced, the effect of the present invention is not diminished at all.

In addition, in the present invention, it is preferred to use a processing method as described in Japanese Patent Publication (unexamined) No. 75352/1986, in which the solution overflowing from the first bath is introduced into the second bath, with the conditions that the oxidation-reduction potential of the first bath having the bleaching ability is higher than that of the second bath, the oxidation-reduction potential of the second bath is within the range of +60 mV to −60 mV, the first bath contains a water-soluble bromide in an amount of 0.5 to 1.3 mole/l, and the second bath contains a water-soluble bromide in an amount of 0 to 0.5 mole/l. As long as the oxidation-reduction potentials of the first and second baths satisfy the conditions of the present invention it is possible, for example, to employ a counter-current cascade method in which the solution of the second bath is passed back into the first bath by a cascade method.

In addition, so long as the oxidation-reduction potential of the first bath is higher than that of the second bath, the oxidation-reduction potential of the second bath is within the range of +60 mV to −60 mV, the first bath contains a water-soluble bromide in an amount of 0.5 to 1.3 mole/l, and the second bath contains a water-soluble bromide in an amount of 0 to 0.5 mole/l, the first and second baths may each be divided into two or more tanks. In this case, it is necessary that the potential of the tank which exhibits the minimum oxidation-reduction potential in the first bath is higher than that of the tank which exhibits the maximum oxidation-reduction potential in the second bath.

Aromatic primary amine type color developing agents used for the color developing solution in the present invention include known agents which are widely used in various color photographic processes.

Such developing agents include aminophenol type and p-phenylenediamine type derivatives. These compounds are generally used in the form of a salt, for example, a hydrochloride or sulfate, because they are most stable in such a state than in the free state. These compounds are generally used in a concentration of about 0.1 g to about 30 g per liter of the color developing solution, preferably, about 1 g to about 15 g per liter of the color developing solution.

Examples of aminophenol type developing agents include o-aminophenol, p-aminophenol, 5-amino-2-oxytoluene, 4-amino-2-methylphenol, 2-amino-3-methylphenol, 2-amino-3-oxy-toluene, 2-oxy-3-amino-1,4-dimethyl-benzene.

In particular, N,N-dialkyl-p-phenylenediamine type compounds are useful aromatic primary amine type color developing agents, and their alkyl and phenyl groups may either be substituted or not substituted. Of these compounds, examples of particularly useful compounds include N,N-dimethyl-p-phenylenediamine hydrochloride, N-methyl-p-phenylenediamine hydrochloride, 2-amino-5-(N-methyl-N-dodecylamino)-toluene, N-ethyl-N-β-methanesulfonamidoethyl-3-methyl-4-aminoaniline sulfate, N-ethyl-N-β-hydroxyethylaminoaniline, 4-amino-3-methyl-N,N-diethylaniline, and 4-amino-N-(2-methoxyethyl)-N-ethyl-3-methylaniline-p-toluenesulfonate.

An alkaline color developing solution used in the present invention may also contain various components which are generally added as required to color developing solutions, for example, alkaline agents such as sodium hydroxide, sodium carbonate, and potassium carbonate, alkali metal sulfites; alkali metal bisulfites; alkali metal thiocyanates; alkali metal halide; benzyl alcohol; a water softener; and a thickening agent in addition to the above-mentioned aromatic primary amine type color developing agent. The pH value of the color developing solution is usually at least 7, most generally about 9 to about 13.

The method of the present invention can be used for color reversal processing. In the present invention, as a black-and-white developing solution used in this processing, it is possible to use a known solution which is used for the reversal processing of color photographic light-sensitive materials and is called a black-and-white primary developing solution, or a solution used for processing black-and-white light-sensitive materials. The developing solution may also contain various known additives which are generally often added to such a black-and-white developing solution.

Typical additives include primary developing agents such as 1-phenyl-3-pyrazolidone, Methol, and hydroquinone; preservatives such as sulfites; accelerators comprising alkalis such as sodium hydroxide, sodium carbonate, and potassium carbonate; inorganic or organic inhibitors such as potassium bromide, 2-methylbenzimidazole, and methylbenzthiazole; a hard-water softener such as polyphosphate; and a developing inhibitor comprising a small amount of iodide and a mercapto compound.

After the treatment in the bath having bleaching ability, after-treatment such as water washing and stabilization is usually carried out.

In the water washing process and the stabilization process, various known compounds may be added for the purpose of prevention of precipitation and stabilization of washing water. For instance, chelating agents such as inorganic phosphoric acid, aminopolycarboxylic acid, organic phosphonic acid, bactericides for inhibition of various bacteria or mold, or anti-mold agents such as those described in J. Antibact. Antifung. Agents, vol. 11, No. 5 pp. 207–223 (1983) and those described in Bokin Bobai no Kagaku (chemistry for inhibition of bacteria and mold). Hiroshi Horiguchi, metal salts such as magnesium salts, aluminum salts and bismuth, salts of alkali metals and ammonium, and surfactants for prevention of unevenness or the reduction of load for drying may be used. Alternatively, compounds described in L. E. West, "Water Quality Criteria" Phot. Sci. and Eng. vol. 9, No. 6, pp 344–359 (1956), may be used. Particularly, chelating agents, bactericides and anti-mold agents are effectively used.

The water washing process is usually carried out in a multi-step counterflow manner consisting of more than two baths (e.g., 2 to 9 baths) to save the amount of washing water. Otherwise, multi-step counterflow stabilization process may be carried out instead of the water washing process.

In the stabilizing bath, various compounds other than the aforesaid additives are added for the purpose of stabilizing the image. For instance, various buffer agents for adjusting the pH of the membrane (e.g., to pH 3 to 9), such as a combination of borate, metaborate, borax, phosphates, carbonates, potassium hydroxide, sodium hydroxide, aqueous ammonium, monocarboxylic acids, dicarboxylic acids and, polycarboxylic acids, and aldehydes such as formalin may be used. In addition, chelating agents such as inorganic phosphoric acid, aminopolycarboxylic acid, organic phosphonic acid, aminopolyphosphonic acid and hosphonocarboxylic acid, bactericides, anti-mold such as thiazole, isothiazoles, halogenated phenols, sulfanylamide and benzotriazole, surfactants, fluorescent whiteners and hardening metal salts may also be used. Two or more of these may be used in combination for the same purpose or for different purposes.

Further, addition of various ammonium salts such as ammonium chloride, ammonium nitrate, ammonium sulfate, ammonium phosphate, ammonium sulfite and ammonium thiosulfate as a pH adjusting agent after the processing is preferred in order to improve preservability of the image.

Further, in the color photographic materials for taking pictures, it is possible to substitute the water washing and stabilizing step after fixing, which is usually carried out, with the stabilizing step and the water washing step (water-saving manner) as described above. In this case, formalin may not be added to the stabilizing solution if only the 2-equivalent coupler is used as a magenta coupler.

Each of the process solutions is used at a temperature of from 10° to 50° C. A range of from 33° to 38° C. is a standard. However, a higher temperature may be used to facilitate the process and to shorten the time period of the process. In contrast, a lower temperature may also be used to improve the quality of the image and the stability of the process solution. Further, in order to save the amount of silver in the light-sensitive materials, the process where cobalt intensifier or hydrogen peroxide intensifier described in German Patent No. 2,226,770 and U.S. Pat. No. 3,674,499 or the single bath develop-bleach-fixing process described in U.S. Pat. No. 3,923,511 may be used.

Further, each of the time periods of the processes may be shorter than a standard one for a quick processing as far as no serious disadvantage takes place.

For the purpose of simplifying and facilitating the process, the color developing agent or precursor thereof may be incorporated into the silver halide color photographic materials according to the invention. In the event of incorporation, the precursor is preferred on account of higher stability of the photographic materials. As examples of the precursors of developing agents, there can be named, for instance, indoaniline type compounds described in U.S. Pat. No. 3,342,597, shiff base type compounds described in U.S. Pat. No. 3,342,599, Research Disclosures 14850 (August, 1976) and 15159 (November, 1976), aldols described in Research Disclosure 13924, metal salt complexes described in U.S. Pat. No. 3,719,492, and urethane compounds described in Japanese Patent Publication (unexamined) 135628/1978. Various precursors of a salt type as described in Japanese Patent Publications (unexamined) Nos. 6235/1981, 16133/1981, 59232/1981, 67842/1981, 83734/1981, 83735/1981, 83736/1981, 89735/1981, 81837/1981, 54430/1981, 106241/1981, 107236/1981, 97531/1982 and 83565/1982 may also be used in the invention.

Various 1-phenyl-3-pyrazolidones may be incorporated into the silver halide photographic materials according to the invention to facilitate the color development. Typical compounds of such are disclosed in Japanese Patent Publications (unexamined) Nos. 64339/1981, 144547/1982, 211147/1982, 50532/1983, 5053/1983, 50533/1983, 50534/1983, 50536/1983 and 115438/1983.

In the case of a continuous process, replenishers are fed to corresponding treatment baths so as to prevent changes in the compositions of the bath solutions, which results in constant finished properties. The amount of a replenisher may be decreased to half or less of a standard amount to save cost when necessary Each treatment bath may be provided with a heater, temperature sensor, level sensor, circulation pump, filter, various floating covers, and various squeezes.

The present invention can be applied to various color photogrpahic materials. Typical examples include general-purpose or movie color negative films, color reversal films for slides or television, color papers, color positive films, and color reversal papers. The invention can also be applied to black-and-white light-sensitive materials employing trichromatic coupler mixing, as described in Research Disclosure No. 17123 (July, 1978), etc. In particular, the present invention is preferably applied to light-sensitive materials for photofinishing.

EXAMPLES

The present invention is explained in detail below with reference to examples.

EXAMPLE 1

A multi-layer color negative film sample, whose layers have the following compositions, was prepared on a triacetyl cellulose film support:

1st layer: Antihalation layer
gelatine layer containing black colloidal silver.
2nd layer: Intermediate layer
gelatine layer containing an emulsion dispersion of 2,5-di-t-octylhydroquinone,
3rd layer: Low-speed red-sensitive emulsion layer
silver iodobromide emulsion (silver iodide: 5 mol %): amount of coated silver 1.6 g/m$^2$
sensitizing dye I: $6\times10^{-5}$ mole per mole of silver
sensitizing dye II: $1.5\times10^{-5}$ mole per mole of silver
coupler EX-8: 0.04 mole per mole of silver
coupler EX-1: 0.003 mole per mole of silver
coupler EX-2: 0.0006 mole per mole of silver.
4th layer: High-speed red-sensitive emulsion layer
silver iodobromide emulsion (silver iodide: 10 mole %): amount of coated silver 1.4 g/m$^2$.
sensitizing dye I: $3\times10^{-5}$ mole per mole of silver
sensitizing dye II: $1.2\times10^{-5}$ mole per mole of silver
coupler EX-9: 0.02 mole per mole of silver
coupler EX-1: 0.0016 mole per mole of silver
5th layer: Intermediate layer
same as the 2nd layer.
6th layer: Low-speed green-sensitive emulsion layer
monodisperse silver iodobromide emulsion (silver iodide: 4 mol %); amount of coated silver 1.2 g/m$^2$
sensitizing dye III: $3\times10^{-5}$ mole per mole of silver
sensitizing dye IV: $1\times10^{-5}$ mole per mole of silver
coupler EX-3: 0.05 mole per mole of silver
coupler Ex-4: 0.008 mole per mole of silver
coupler EX-2: 0.0015 mole per mole of silver.
7th layer: High-speed green-sensitive emulsion layer
silver iodobromide emulsion (silver iodide: 10 mol %); amount of coated silver 1.3 g/m$^2$
Sensitizing dye III: $2.5\times10^{-5}$ mole per mole of silver
sensitizing dye IV: $0.8\times10^{-5}$ mole per mole of silver
coupler EX-5: 0.017 mole per mole of silver
coupler EX-4: 0.003 mole per mole of silver
coupler EX-6: 0.003 mole per mole of silver.
8th layer: Yellow filter layer
gelatine layer of an aqueous gelatine solution containing yellow colloidal silver and an emulsified dispersion of 2,5-di-t-octylhydroquinone.
9th layer: Low-speed blue-sensitive emulsion layer
silver iodobromide emulsion (silver iodide: 6 mol %): amount of coated silver 0.7 g/m$^2$
coupler EX-7: 0.25 mole per mole of silver
coupler EX-2: 0.015 mole per mole of silver.
10th layer: High-speed blue-sensitive layer
silver iodobromide (siliver iodide: 6 mol ): amount of coated silver 0.6 g/m$^2$
coupler EX-7: 0.06 mole per mole of silver.
11th layer: First protective layer
siliver iodobromide (silver iodide: 1 mole %, average grain size 0.07$\mu$): amount of coated silver 0.5 g/m$^2$ gelatine layer containing an emulsified dispersion of UV absorbant UV-1
12th layer: Second protective layer gelatine layer containing trimethylmethacrylate grains (grain size: about 1.5$\mu$)

A gelatine hardener H-1 and a surfactant were added to each of the layers, in addition to the above-described compositions.

The compounds used for preparing the samples are as follows:

Sensitizing dye I: Anhydro-5,5'-dichloro-3,3'-di-$\gamma$-(sulfopropyl)-9-ethyl-thiacarbocyanine hydroxide pyridinium salt Sensitizing dye II: Anhydro-9-ethyl-3,3'-di-($\gamma$-sulfopropyl)-4,5,4',5'-dibenzothiacarbocyanine hydroxide triethylamine salt Sensitizing dye III: Anhydro-9-ethyl-5,5'-dichloro-3,3'-di-($\gamma$-sulfopropyl)oxacarbocyanine sodium salt Sensitizing dye IV: Anhydro-5,6,5',6'-tetrachloro-1,1'-diethyl-3,3'-di-{$\beta$-,$\beta$-($\gamma$-sulfopropyl)ethoxy.ethyl} imidazolocarbocyanine hydroxide sodium salt.

EX-1
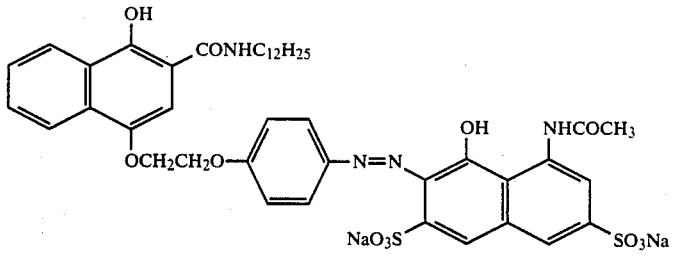
EX-2
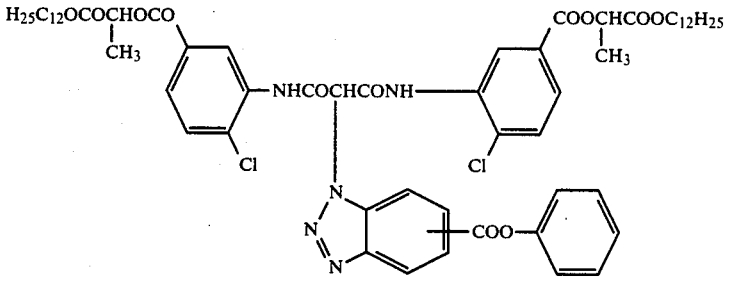
EX-3
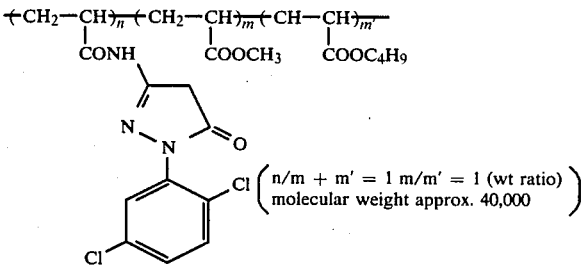
EX-4
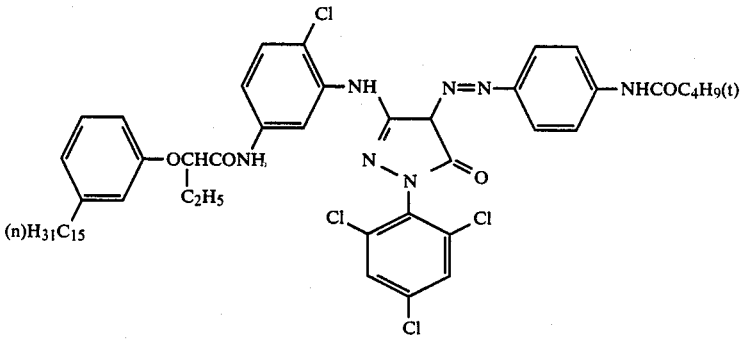
EX-5
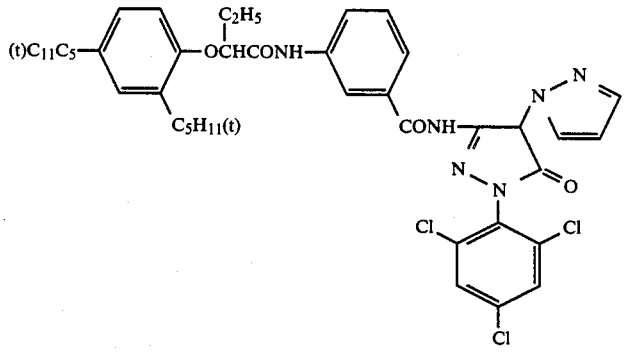

-continued

EX-6

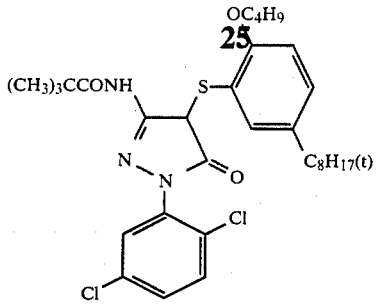

EX-7

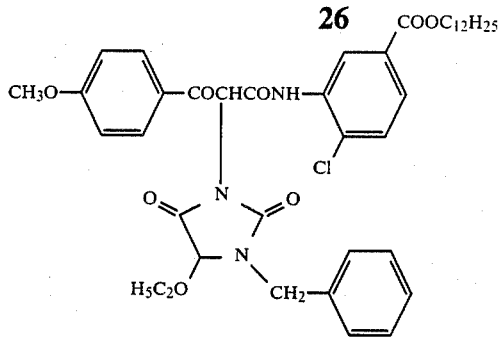

EX-8

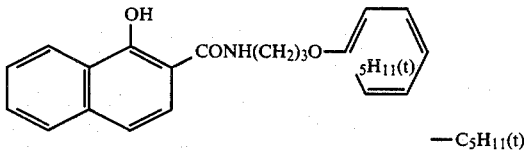

EX-9

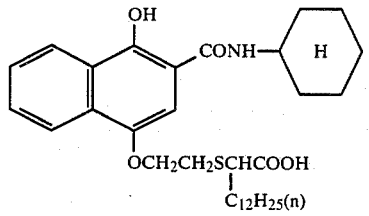

H-1

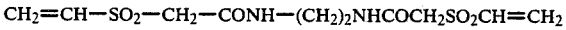

UV-1

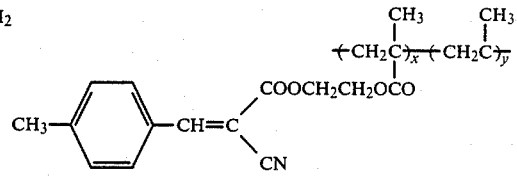

After the color negative film had been subjected to 20 cms wedge exposures using a tungsten light source adjusted by a filter at a color temperature of 4800° K., development was performed at 38° C. in accordance with the following processing steps:

| | |
|---|---|
| Treatment 1 (comparative treatment) | |
| Color development | 3 min. 15 sec. |
| Bleaching | 1 min. 30 sec. |
| Fixing | 3 min. 15 sec. |
| Water washing | 3 min. 15 sec. |
| Stabilization | 1 min. 05 sec. |
| Treatment 2 (comparative treatment) | |
| Color development | 3 min. 15 sec. |
| Bleach-fixing | 6 min. |
| Water washing | 3 min. 15 sec. |
| Stabilization | 1 min. 05 sec. |
| Treatment 3 (treatment of the invention) | |
| Color development | 3 min. 15 sec. |
| Bath (1) having bleaching ability | 1 min. 30 sec. |
| Bath (2) having bleaching ability | 3 min. 15 sec. |
| Water washing | 3 min. 15 sec. |
| Stabilization | 1 min. 05 sec. |

The compositions of the treatment solutions used in each step are as follows:

| | |
|---|---|
| Color developing solution | |
| trisodium nitrilotriacetate | 1.9 g |
| sodium sulfite | 4.0 g |
| potassium carbonate | 30.0 g |
| potassium bromide | 1.4 g |
| potassium iodide | 1.3 mg |
| hydroxylamine sulfate | 2.4 g |
| 4-(N—ethyl-N—β-hydroxyethylamino)-2-methylaniline sulfate | 4.5 g |

-continued

| | |
|---|---|
| water to | 1.0 l |
| pH | 10.0 |
| Bleaching solution | |
| ferric ammonium ethylenediamine tetraacetate | 100.0 g |
| disodium ethylenediamine tetraacetate | 8.0 g |
| ammonium bromide | 100.0 g |
| aqueous ammonium (28%) | 7.0 ml |
| water to | 1.0 l |
| pH | 6.0 |
| Fixing solution | |
| sodium tetrapolyphosphate | 2.0 g |
| sodium sulfite | 4.0 g |
| aqueous solution of ammonium thiosulfate (70%) | 175.0 ml |
| sodium bisulfite | 4.6 g |
| water to | 1.0 l |
| pH | 6.6 |
| Bleach fixing solution | |
| ferric ammoniun ethylenediamine tetraacetate | 100.0 g |
| disodium ethylenediamine tetraacetate | 8.0 g |
| aqueous solution of ammonium thiosulfate (70%) | 175.0 ml |
| sodium bisulfite | 4.5 g |
| aqueous ammonium | 5 ml |
| water to | 1.0 l |
| pH | 6.0 |
| Stabilization solution | |
| Formalin (40%) | 8.0 ml |
| Fuji Driwel (produced by Fuji Photo Film Co., Ltd.) | 5.0 ml |
| water to | 1.0 l |

The bath (1) having bleaching ability was prepared by adding 5 g of sodium sulfite and a predetermined amount of an aqueous ammonium thiosulfate solution (70%) to 1l of the above composition of the bleaching solution. The bath (2) having bleaching ability consisted of just the above composition of the bleach fixing solution. The oxidation-reduction potentials of the samples were each measured, and differences in oxidation-reduction potential between the baths (1)and (2) having bleaching ability are given in Table 1.

Each of the samples which had been subjected to the above treatments was examined to determine its minimum density, gradation, and the amount of silver remaining in the portion with the maximum color density was measured by X-ray fluoroscopy.

In addition, each of the same samples was subjected to the Fuji Color Process CN-16 treatment of Fuji Photo Film Co., Ltd. (color development: 3 min. 15 sec.; bleaching: 6 min. 30sec.; water washing: 2 min. 10 sec.; fixing: 4 min. 20 sec.; water washing: 3 min. 15 sec.; stabilization: 1 min. 5 sec.; drying; at treatment temperature: 38° C.), and the minimum density and gradation of each were examined in a similar manner and were compared with the results of the above treatment.

The results of the compositions are shown in Table 1 in terms of differences in characteristics between the treamtment of the present invention and the standard treatment (CN-16). However, the minimum density values showed no significant differences, and so, they are not shown in the table. Therefore, this table shows that the more the gradation values in Table 1 differ from zero, the greater the differences from the standard treatment and the worse the photographic properties.

Table 1 also shows the results of measurements of the amounts of silver.

In this example, the gradation was obtained by the following method:

Gradation: The exposure required for increasing the density by 0.2 from the minimu density was determined for each standard treatment sample. For each of the treatment samples of this invention, the difference between the density at this exposure and that at the point where the exposure corresponding to 1.5 in terms of logarithm was added to this exposure was considered to be the gradation.

TABLE 1

| Sample No. | Treatment | Oxidation-reduction potential difference (mV) (Bleaching Bath (1)-(2)) | Amount of remaining silver ($\mu g/cm^2$) | Gradation B | Gradation G | Gradation R | |
|---|---|---|---|---|---|---|---|
| 1 | 1 | — | 12.0 | +0.10 | +0.08 | +0.06 | Comparison |
| 2 | 2 | — | 20.2 | +0.09 | " | +0.04 | " |
| 3 | 3 | −50 | 16.0 | +0.08 | " | +0.05 | " |
| 4 | " | −20 | 15.0 | " | +0.07 | " | " |
| 5 | " | 0 | 13.9 | +0.07 | " | +0.04 | " |
| 6 | " | +10 | 6.0 | +0.01 | +0.01 | ±0 | Invention |
| 7 | " | +20 | 4.6 | ±0 | ±0 | " | " |
| 8 | " | +40 | 3.0 | " | " | " | " |
| 9 | " | +60 | 2.5 | " | " | " | " |
| 10 | " | +80 | 2.4 | " | " | ±0.01 | " |
| 11 | " | +100 | 2.2 | " | " | " | " |
| 12 | " | +120 | 2.1 | " | " | ±0 | " |
| 13(1) | " | 0 | 15.3 | " | +0.07 | +0.05 | Comparison |

(1)The bleaching baths 1 and 2 have the bleach-fixing solution compositions used in Example 1.

As can be seen from Table 1, the samples subjected to the treatments of the present invention (Sample 6 to 12) show an extremely accelerated desilvering and excellent photographic properties, without any gradation change in the cyan color images (formation of leuco type of cyan dye), when compared with samples subjected to conventional bleaching-fixing (Sample 1), single bleach fixing (Sample 2), treatment using two baths of the bleach fixing solutions which had the same composition and the same oxidation-reduction potential (Sample 13), and treatments under the condition that the oxidation-reduction potential of the first bath having bleaching ability was lower than that of the second bath (Samples 3 to 5). In particular, it was found that the higher the oxidation-reduction potential of the first bath having bleaching ability relative to that of the second bath, the higher the speed of desilvering.

EXAMPLE 2

As a bleaching accelerator, $1\times10^{-2}$ mole of compound A or B, shown below, was added to one liter of the bleaching solution, the bleach fixing solution and the first bath having bleaching ability of Example 1 of the present invention, and the same treatments as those of Example 1 were made to obtain results similar to those of Example 1.

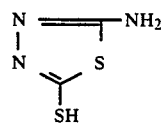

Compound A

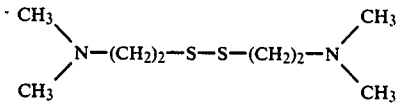

Compound B

EXAMPLE 3

The same treatments as those of Example 1 were made, except that ferric ammonium diethylenetriamine pentaacetate was used instead of ferric ammonium ethylenediamine tetraacetate in the bleaching solution, the bleach fixing solution, and the processing baths (1) and (2) having bleaching ability of the present invention of Example 1, and results similar to those of Example 1 were obtained.

EXAMPLE 4

After the color photographic materials which had been formed in a manner similar to that of Example 1 were subjected to 25 CMS uniform exposure using a tungsten light source adjusted by a filter at a color temperature of 4800° K., development was performed at 38° C. in accordance with the following treatment:

| Treatment | |
|---|---|
| Color development | 3 min. 15 sec. |

-continued

| Treatment | |
|---|---|
| Bath (1) having bleaching ability (A, B, C, or E as shown in Table 2) | 2 min. |
| Bath (2) having bleaching ability (A, B, C, D, or F as shown in Table 2) | 3 min. |
| Water washing | 3 min. 15 sec. |
| Stabilization | 1 min. 05 sec. |

The compositions of the processing solutions used in the above treatment are as follows:

| | |
|---|---|
| Color developing solution | |
| diethylenetriamine pentaacetic acid | 1.0 g |
| 1-hydroxyethylidene-1,1-diphosphonic acid | 2.0 g |
| sodium sulfite | 4.0 g |
| potassium carbonate | 30.0 g |
| potassium bromide | 1.4 g |
| potassium iodide | 1.3 m |
| hydroxylamine sulfate | 2.4 g |
| 4-(N—ethyl-N—β-hydroxyethylamino)-2-methylaniline sulfate | 4.5 g |
| water to | 1.0 l |
| pH | 10.0 |
| Stabilization solution | |
| Formalin | 2.0 g |
| polyoxyethylene-p-monononylphenyl ether (average degree of polymerization: 10) | 0.3 g |
| water to | 1.0 l |

TABLE 2

| | <Bleaching Baths (1) and (2)> | | | | | |
|---|---|---|---|---|---|---|
| | A | B | C | D | E | F |
| Ferric ammonium ethylenediaminetetraacetate | 80 g | 80 g | 80 g | 80 g | 80 g | 10 g |
| Disodium ethylenediaminetetraacetate | 10.0 g | 10.0 g | 10.0 g | 10.0 g | 10.0 g | 10.0 g |
| Ammonium nitrate | 10.0 g | 10.0 g | 10.0 g | 10.0 g | 10.0 g | 10.0 g |
| Ammonium bromide | 160 g | 160 g | 160 g | 160 g | 160 g | 160 g |
| Sodium sulfite | 2.0 g | 10.0 g | 25.0 g | 2.0 g | — | 30.0 g |
| Ammonium thiosulfate (70%) | 200 ml | 200 ml | 200 ml | 20 ml | — | 250 ml |
| Water | 1.0 l | 1.0 l | 1.0 l | 1.0 l | 1.0 l | 1.0 l |
| pH (adjusted with aqueous ammonium) | 6.0 | 6.0 | 6.0 | 6.0 | 6.0 | 6.0 |
| Oxidation-reduction potential | +41 mV | +22 mV | 0 mV | +70 mV | +170 mV | −70 mV |

The amount of silver remaining in each of the samples subjected to the above treatments was measured by X-ray fluoroscopy. The results are given in Table 3.

TABLE 3

| No. | Bleaching Bath (1) | Bleaching Bath (2) | Difference in oxidation-reduction potential [Bleaching Bath (1)-(2)] | Amount of remaining silver (g/cm$^2$) | |
|---|---|---|---|---|---|
| 1 | A | C | +41 mV | 2.7 | Invention |
| 2 | B | C | +22 mV | 5.3 | Invention |
| 3 | C | C | 0 mV | 15.6 | Comparison |
| 4 | C | B | −22 mV | 16.2 | Comparison |
| 5 | C | A | −41 mV | 17.9 | Comparison |
| 6 | E | D | +100 mV | 680 | Comparison |
| 7 | E | F | +240 mV | 32 | Comparison |

As shown in Table 3, the examples of the present invention exhibit extremely good desilvering properties.

EXAMPLE 5

The same procedures as in Example 1 were repeated except that coupler EX-10 was used instead of coupler EX-8, to obtain a color negative film.

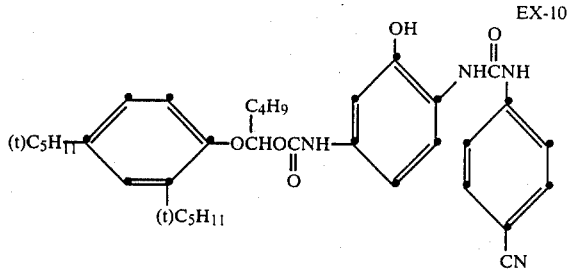

After the color negative film had been subjected to 25 cms wedge exposures using a tungsten light source adjusted by a filter at a color temperature of 4800° K., development was performed at 38° C. in accordance with the following processing steps:

| | |
|---|---|
| Color development | 3 min. 15 sec. |
| Bleaching | 1 min. |
| Bleach-fixing | 3 min. 15 sec. |
| Water washing | 1 min. 40 sec. |
| Stabilization | 40 sec. |

The compositions of the treatment solution used in each step are as follows:

| | |
|---|---|
| Color developing solution | |
| Diethylenetriamine pentaacetic acid | 1.0 g |
| 1-hydroxyethylidine-1,1-diphosphonic acid | 2.0 g |
| sodium sulfite | 4.0 g |
| potassium carbonate | 30.0 g |
| potassium bromide | 1.4 g |
| potassium iodide | 1.3 mg |

-continued

| | |
|---|---|
| hydroxylamine sulfate | 2.4 g |
| 4-(N—ethyl-N—β-hydroxyethylamino)-2-methylaniline sulfate | 4.5 g |
| water to | 1.0 l |
| pH | 10.0 |
| Bleaching solution (Bath (1)) | |
| ferric ammonium ethylenediamine tetraacetate | 120.0 g |
| disodium ethylenediamine tetraacetate | 10.0 g |
| aqueous ammonium (28%) | 17.0 ml |
| ammonium nitrate | 10.0 g |
| ammonium bromide | as shown in Table 4 |
| bleach accelerator (as shown in Table 4) | $5 \times 10^{-3}$ mole |
| water to | 1.0 l |
| pH | 6.5 |
| Bleach fixing solution (Bath (2)) | |
| ferric ammonium ethylenediamine tetraacetate | 50.0 g |
| disodium ethylenediamine tetraacetate | 5.0 g |
| aqueous solution of ammonium thiosulfate (70%) | 240.0 ml |
| sodium bisulfite | 12.0 g |
| aqueous ammonium | 10 ml |
| water to | 1.0 l |
| pH | 7.3 |
| Stabilization solution | |
| Formalin (37% W/V) | 2.0 ml |
| Polyoxyethylene-p-mononoylphenyl ether (average degree of polymerization) | 0.3 g |
| water to | 1.0 l |

Each of the samples which had been subjected to the above treatments was examined to determine the amount of silver remaining in the portion with the maximum color density by X-ray fluoroscopy. The results are shown in Table 4.

TABLE 4

| No. | Ammonium bromide in Bath (1) (mole/l) | Bleach accelerator | Oxidation-reduction potential: Bath (2) (mV) | Oxidation-reduction potential: Difference (Bath (1)-(2)) (mV) | Amount of remaining silver ($\mu g/cm^2$) |
|---|---|---|---|---|---|
| 1 Comparison | $3 \times 10^{-1}$ | B | −5 | 145 | 45.0 |
| 2 Comparison | $3 \times 10^{-1}$ | A | −5 | 130 | 67.5 |
| 3 Invention | $5 \times 10^{-1}$ | B | −5 | 145 | 3.8 |
| 4 Invention | $5 \times 10^{-1}$ | A | −5 | 130 | 4.4 |
| 5 Invention | 1.0 | B | −5 | 145 | 1.7 |
| 6 Invention | 1.0 | A | −5 | 130 | 1.9 |
| 7 Invention | 1.3 | B | −5 | 145 | 2.4 |
| 8 Invention | 1.3 | A | −5 | 130 | 2.9 |
| 9 Comparison | 1.7 | B | −5 | 145 | 8.9 |
| 10 Comparison | 1.7 | A | −5 | 130 | 10.1 |

The maximum amount of remaining silver is 5 $\mu g/cm^2$ from the standpoints of practical photographic properties. The amount of remaining silver was below 5 $\mu g/cm^2$ for all the samples of the present invention, while it was above 5 $\mu g/cm^2$ for Comparison samples 1, 2, 9 and 10.

EXAMPLE 6

The same treatments as those of Example 5 were made, except that ferric ammonium diethylenetriamine pentaacetate was used instead of ferric ammonium ethylenediamine tetraacetate in the bleaching solution and the bleach-fixing solution of Example 5, and results similar to those of Example 5 were obtained.

EXAMPLE 7

After the color photographic materials which had been formed in a manner similar to that of Example 5 were subjected to the same treatment as in Example 5, development was performed at 38° C. in accordance with the following treatment:

| Treatment | |
|---|---|
| Color development | 3 min. 15 sec. |
| Bleaching | 50 sec. |
| Bleach-fixing | 3 min. |
| Water washing | 1 min. 40 sec. |
| Stabilization | 40 sec. |

The compositions of the processing solutions used in the above treatment are as follows:

| | |
|---|---|
| Color developing solution | |
| The same as in Example 5. | |
| Bleaching solution (Bath (1)) | |
| ferric ammonium ethylenediamine tetraacetate | 120.0 g |
| disodium ethylenediamine tetraacetate | 10.0 g |
| aqueous ammonium (28%) | 17.0 ml |
| ammonium nitrate | 10.0 g |
| ammonium bromide | as shown in Table 5 |
| bleach accelerator (as shown in Table 5) | $5 \times 10^{-3}$ mole |
| water to | 1.0 l |
| pH | 6.5 |
| Bleach-fixing solution (Bath (2)) | |
| ferric ammonium ethylenediamine tetraacetate | 50.0 g |
| disodium ethylenediamine tetraacetate | 5.0 g |
| aqueous solution of ammonium thiosulfate (70%) | 240.0 ml |
| sodium bisulfite | 12.0 g |
| aqueous ammonium | 10 ml |
| ammonium bromide | as shown in Table 5 |
| water to | 1.0 l |
| pH | 7.3 |
| Stabilization solution | |
| The same as in Example 5. | |

Each of the samples which had been subjected to the above treatments was examined to determine the amount of silver remaining in the portion with the maximum color density by X-ray fluoroscopy. The results are shown in Table 5.

TABLE 5

| No. | Ammonium bramide in Bath(2) (mole/l) | Bleach accelerator in the bleaching solution | Oxidation-reduction potential Bath (1) (mV) | Difference (Bath (1)-(2)) (mV) | Amount of remaining silver ($\mu g/cm^2$) |
|---|---|---|---|---|---|
| 1 Invention | 0 | B | −5 | 145 | 5.2 |
| 2 Invention | 0 | A | −5 | 130 | 5.5 |
| 3 Invention | $1 \times 10^{-1}$ | B | −5 | 145 | 3.5 |
| 4 Invention | $1 \times 10^{-1}$ | A | −5 | 130 | 4.0 |
| 5 Invention | $3 \times 10^{-1}$ | B | −5 | 145 | 1.0 |
| 6 Invention | $3 \times 10^{-1}$ | A | −5 | 130 | 1.5 |
| 7 Invention | $5 \times 10^{-1}$ | B | −5 | 145 | 1.3 |
| 8 Invention | $5 \times 10^{-1}$ | A | −5 | 130 | 1.9 |
| 9 Comparison | $8 \times 10^{-1}$ | B | −5 | 145 | 10.2 |
| 10 Comparison | $8 \times 10^{-1}$ | A | −5 | 130 | 13.5 |

As seen from Table 5, the amount of remaining silver reached below about 5 $\mu g/cm^2$ in a short time in the samples of the present invention but did not in those of Comparison.

EXAMPLE 8

The same procedures as in Example 7 were repeated except that ferric ammonium diethylenetriamine pentaacetate was used instead of ferric ammonium ethylenediamine tetraacetate in the bleaching and the bleach-fixing solutions. The same results as those obtained in Example 7 were obtained.

EXAMPLE 9

The color photographic material prepared in Example 5 was exposed in the same manner as in Example 5, and then developed at 38° C. according to the following procedures.

After the color negative film had been subjected to 25 cms wedge exposures using a tungsten light source adjusted by a filter at a color temperature of 4800° K., development was performed at 38° C., in accordance with the following processing steps:

| | Treatment (1) | Treatment (2) |
|---|---|---|
| Color development | 3 min. 15 sec. | 3 min. 15 sec. |
| Bleaching | 3 min. 15 sec. | — |
| Bleach-fixing | 3 min. 15 sec. | 6 min. 30 sec. |
| Water washing | 1 min. 40 sec. | 1 min. 40 sec. |
| Stabilization | 40 sec. | 40 sec. |

The compositions of the treatment solutions used in each step are the same as those used in Example 5 except for the following compositions.

| | |
|---|---|
| Bleaching solution (Bath (1)) | |
| ferric ammonium ethylenediamine tetraacetate | 120.0 g |
| disodium ethylenediamine tetraacetate | 10.0 g |
| aqueous ammonium (28%) | 17.0 ml |
| ammonium nitrate | 10.0 g |
| ammonium bromide | 100.0 g |
| water to | 1.0 l |
| pH | 6.5 |
| Bleach-fixing solution (Bath (2)) | |
| ferric ammonium ethylenediamine tetraacetate | 50.0 g |
| disodium ethylenediamine tetraacetate | 5.0 g |
| aqueous solution of ammonium thiosulfate (70%) | 240.0 ml |
| sodium bisulfite | 12.0 g |
| aqueous ammonium | 10 ml |
| ammonium bromide | as shown in Table 6 |
| water to | 1.0 l |
| pH | 6.0 |

Each of the samples which had been subjected to the above treatments was examined to determine the amount of silver remaining in the portion with the maximum color density by X-ray fluoroscopy. The results are shown in Table 6.

TABLE 6

| No. | Treatment | Ammonium bromide in Bath (2) (mole/l) | Oxidation-reduction potential Bath (2) (mV) | Difference (Bath (1)-(2)) (mV) | Amount of remaining silver ($\mu g/cm^2$) |
|---|---|---|---|---|---|
| 1 Invention | 1 | 0 | −5 | 145 | 5.0 |
| 2 Invention | 1 | $3 \times 10^{-1}$ | −5 | 145 | 1.2 |
| 3 Comparison | 1 | $8 \times 10^{-1}$ | −5 | 145 | 8.5 |
| 4 Comparison | 2 | 0 | −5 | | 19.6 |
| 5 | 2 | $1 \times 10^{-1}$ | −5 | | 21.2 |

TABLE 6-continued

| No. | Treatment | Ammonium bromide in Bath (2) (mole/l) | Oxidation-reduction potential Bath (2) (mV) | Difference (Bath (1)-(2)) (mV) | Amount of remaining silver ($\mu g/cm^2$) |
|---|---|---|---|---|---|
| Comparison 6 | 2 | $3 \times 10^{-1}$ | −5 | | 24.5 |
| Comparison 7 | 2 | $5 \times 10^{-1}$ | −5 | | 27.5 |

As seen from Table 6, treatment (2) in which only bleach-fixing step was provided did not improve desilvering.

EXAMPLE 10

The same procedures as in Example 5 were repeated except that the bleaching solution was changed as follows:

| Bleaching solution (Bath (1)) | |
|---|---|
| ferric ammonium ethylenediamine tetraacetate | 120.0 g |
| disodium ethylenediamine tetraacetate | 12.0 g |
| aqueous ammonium (28%) | 10.0 ml |
| sodium bisulfite | 2 g |
| aqueous solution of ammonium thiosulfate (70%) | 10 ml |
| ammonium nitrate | 11 g |
| ammonium bromide | as shown in Table 7 |
| bleach accelerator (as shown in Table 7) | $5 \times 10^{-3}$ mole/l |
| water to | 1.0 l |
| pH | 6.4 |

Each of the samples which had been subjected to the above treatments was examined to determine the amount of silver remaining in the portion with the maximum color density by X-ray fluoroscopy. The results are shown in Table 7.

TABLE 7

| No. | Ammonium bromide in Bath(1) (mole/l) | Bleach accelerator | Oxidation-reduction potential Bath (2) (mV) | Difference (Bath (1)-(2)) (mV) | Amount of remaining silver ($\mu g/cm^2$) |
|---|---|---|---|---|---|
| 1 Comparison | $3 \times 10^{-1}$ | B | −5 | 65 | 46.1 |
| 2 Comparison | $3 \times 10^{-1}$ | A | −5 | 60 | 70.0 |
| 3 Invention | $5 \times 10^{-1}$ | B | −5 | 65 | 3.7 |
| 4 Invention | $5 \times 10^{-1}$ | A | −5 | 60 | 4.5 |
| 5 Invention | 1.0 | B | −5 | 65 | 1.9 |
| 6 Invention | 1.0 | A | −5 | 60 | 1.9 |
| 7 Invention | 1.3 | B | −5 | 65 | 2.6 |
| 8 Invention | 1.3 | A | −5 | 60 | 3.3 |
| 9 Comparison | 1.7 | B | −5 | 65 | 9.5 |
| 10 Comparison | 1.7 | A | −5 | 60 | 9.9 |

What is claimed is:

1. A method of processing a silver halide color photographic material which comprises (i) image-wise exposing said silver halide color photographic material, (ii) color developing said material, and (iii) then desilvering said material in a bath having bleaching ability, wherein the bath having bleaching ability comprises two baths, the oxidation-reduction potential of the first bath being higher than that of the second bath, the oxidation-reduction potential of the second bath falling in the range of +60 mV to −60 mV, the first bath containing a water-soluble bromide in an amount of 0.5 to 1.3 mole/l, and the second bath containing a water-soluble bromide in an amount of 0 to 0.5 mole/l.

2. The method of claim 1, wherein the difference in the oxidation-reduction potential between the first and the second baths is 20 mV or higher.

3. The method of claim 1, wherein the difference in the oxidation-reduction potential between the first and the second baths is 40 mV or higher.

4. The method of claim 1, wherein the first bath contains the water-soluble bromide in an amount of 0.7 to 1.3 mole/l.

5. The method of claim 1, wherein the water-soluble bromide is selected from the group consisting of ammonium bromide, potassium bromide, sodium bromide, lithium bromide, hydrobromic acid, magnesium bromide, calcium bromide and strontium bromide.

6. The method of claim 1, wherein the second bath contains a water-soluble bromide in an amount of 0.1 to 0.5 mole/l.

7. The method of claim 1, wherein the second bath contains a water-soluble bromide in an amount of 0.2 to 0.5 mole/l.

8. The method of claim 1, wherein the bath having bleaching ability contains a bleaching agent selected from the group consisting of ferric complex salts of ethylenediamine tetraacetic acid, diethylenetriamine pentaacetic acid, cyclohexanediamine tetraacetic acid, 1,2-diaminopropane tetraacetic acid, and methylimino diacetic acid.

9. The method of claim 1, wherein the bath having bleaching ability contains a bleach accelerator.

10. The method of claim 9, wherein the bleach accelerator is selected from the group consisting of a compound having a mercapto group or a disulfide bond, a thiazolidine derivatie, a thiourea derivative and an isothiourea derivative.

11. The method of claim 9, wherein the bleach accelerator is contained in an amount of $1\times10^{-5}$ to $10^{-1}$ mole/l.

12. The method of claim 1, wherein the bath having bleaching ability has a pH of 0.5 to 9.0.

13. The method of claim 1, wherein the processing time in the first bath is 20 seconds to 4 minutes, and the processing time in the second bath is 1 to 6 minutes.

14. The method of claim 1, wherein said color photographic material contains a cyan coupler represented by the formula (X) or (XI).

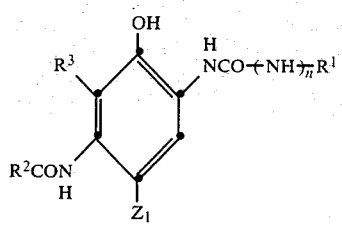

Formula (X)

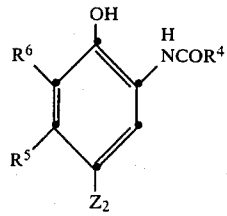

Formula (XI)

wherein $R^1$, $R^2$, and $R^4$ represent a substituted or non-substituted aliphatic hydrocarbyl, aryl or heterocyclic group, $R^3$ and $R^6$ represent hydrogen atom, halogen atom, a substituted or non-substituted aliphatic, aryl or acylamino group, or $R^3$ represent a non-metallic atom group necessary for forming a 5- or 6-membered nitrogen-containing ring together with $R^2$, $R^5$ represents an alkyl group which may be substituted, and $Z_1$ and $Z_2$ represent hydrogen atom or a group which splits off upon coupling reaction.

15. The method of claim 1, wherein solution overflows from the first bath and is introduced into the second bath.

* * * * *